US005775483A

United States Patent [19]

Lown et al.

[11] Patent Number: 5,775,483

[45] Date of Patent: Jul. 7, 1998

[54] STACKABLE CONTAINERS WITH REMOVABLE COVER MEMBERS

[75] Inventors: John M. Lown, Huntington Beach; Thomas J. Marcello, Corona, both of Calif.

[73] Assignee: FloTool Plastics Corporation, Fullerton, Calif.

[21] Appl. No.: 780,967

[22] Filed: Jan. 9, 1997

[51] Int. Cl.[6] ..... B65D 51/18

[52] U.S. Cl. ..... 206/508; 220/296; 220/302

[58] Field of Search ..... 220/306, 318, 220/694, 256, 729, 730, 733, 296, 293, 302; 206/508

[56] References Cited

U.S. PATENT DOCUMENTS

| | | | |
|---|---|---|---|
| 2,606,586 | 8/1952 | Hill . | |
| 4,091,953 | 5/1978 | Daenen . | |
| 4,346,813 | 8/1982 | Cho et al. . | |
| 4,360,119 | 11/1982 | Olivo . | |
| 4,412,630 | 11/1983 | Paenen . | |
| 4,444,332 | 4/1984 | Widen et al. . | |
| 4,473,165 | 9/1984 | Lentjes | 206/508 |
| 4,819,824 | 4/1989 | Longbottom et al. . | |
| 4,872,586 | 10/1989 | Landis . | |
| 5,344,023 | 9/1994 | Cox et al. | 206/508 |
| 5,381,918 | 1/1995 | Dahl | 220/306 |
| 5,409,128 | 4/1995 | Mitchell . | |
| 5,474,184 | 12/1995 | Mandler et al. | 206/508 |

FOREIGN PATENT DOCUMENTS

| | | | |
|---|---|---|---|
| 663827 | 8/1947 | United Kingdom | 206/508 |

*Primary Examiner*—Joseph M. Moy
*Attorney, Agent, or Firm*—Harold L. Jackson

[57] ABSTRACT

This invention relates generally a cover member in combination with an open mouth container formed with a plurality of integral keeper channels and a cover member that includes a plurality of keeper members adapted to lockingly engage the keeper channels that are integrally formed in the collar of the container, whereby the configuration of the cover member and the matching configuration of the associated container are always secured in fixed alignment with each other when the cover is secured over the mouth of the container, whereby the container is readily adapted to be received and stacked in the receptacle of the preceding covered container in a stable vertical formation.

22 Claims, 4 Drawing Sheets

STACKABLE CONTAINERS WITH REMOVABLE COVER MEMBERS

BACKGROUND OF THE INVENTION

1. Field of the Invention

This invention relates to a means for sealing and locking a container cover to an open mouth of a container, and more particularly, the present invention is directed to a cover having a locking and sealing device whereby the configuration of the cover and matching configuration of an associated container (e.g., having flat walls) are always secured in fixed alignment with each other when the cover is secured over the mouth of the container, and wherein the top of the cover is provided with an overall configuration that matches the bottom configuration of the container, whereby the container, whether rectangular or circular, is readily adapted to be received and stacked on a preceding covered container in a stable vertical formation.

2. Description of the Prior Art

As is well known in the art various problems and difficulties are encountered in providing suitable means for securing a cover member to the open mouth of a container where the configuration of the container is not suitable or operably compatible with the cover member. That is, there is a need to provide a container cover member that is capable of being mounted to and over the open mouth of a noncircular container, wherein the cover is required to be rotated through a predetermined angle and wherein the cover will always be locked in place in alignment with the configuration of the container, allowing additional like containers to be readily stackable in a stable manner. The present problem is solved by a new and distinct cover member and a locking and sealing means that establishes a very positive closure between the cover and the container opening, particularly with respect to rigid and semi-rigid plastic containers that have either circular or rectangular cross-sectional configurations.

SUMMARY OF THE INVENTION

Accordingly, it is an important object of the present invention to provide a cover for sealing and locking the open mouth of a container, wherein at least two locking means defined by a pair of keeper channels are employed and oppositely disposed 180° from each other about the container collar that defines the opening or mouth of the container, and wherein the container cover includes a pair of matching or corresponding keeper members that are integrally formed 180° from each other on the peripheral inner wall of the cover, whereby the keeper members will lockingly engage within the respective keeper channels formed in the container collar. The 180° arrangement of the corresponding keeper channels and keeper members limits the rotational movement of the cover to a predetermined angle such as a single 90° turn.

Another object of the present invention is to provide a container cover that is defined by a recessed receptacle which is formed to have a configuration which matches that of the container, whereby the bottom and side walls of the container form a corresponding configuration so that the container will be snugly received in the receptacle of the cover, and wherein the recessed cover portion is provided with a handle that is further recessed in the container cover. Once a container is mounted in its preceding container cover it can be seen that the additional stackable containers will remain in a vertical stable position with or without any contents being stored in the containers.

Still another object of the present invention is to provide a container and container cover of this character that is readily adaptable for use with containers having overall rectangular configurations, whereby the invention will permit the cover to be mounted over the open annular collar, wherein only a pair of the present keeper channels would be required. A container having a round body and a matching round cover can be provided with at least two or more keeper channels, whereby the circular configuration need not be restricted to its position relative to that of the container's configuration, because both the cover and container have identical circular configurations and will always be in matching relationship to each other. This, however, is not true when the container is formed having a rectangular configuration. More specifically, if a container is provided with a rectangular cross-sectional configuration and the cover is also formed having the identical rectangular configuration then the cover must be attached to or placed over the circular collar of the container so that the cover is offset, say 90°, from that of the oppositely disposed keeper channels, and then turned to close the container and align the cover with the container, as will be noted in the following detailed description of the invention.

The characteristics and advantages of the invention are further sufficiently referred to in connection with the accompanying drawings, which represents one embodiment. After considering this example, skilled persons will understand that variations may be made without departing from the principles disclosed; and we contemplate the employment of our structures, arrangements or modes of operation that are properly within the scope of the appended claims.

BRIEF DESCRIPTION OF THE DRAWINGS

With the above and related objects in view, the invention consists in the details of construction and combination of parts, as will be more fully understood from the following description, when read in conjunction with the accompanying drawings and numbered parts.

DETAILED DESCRIPTION OF THE PREFERRED EMBODIMENT

Figure 1:
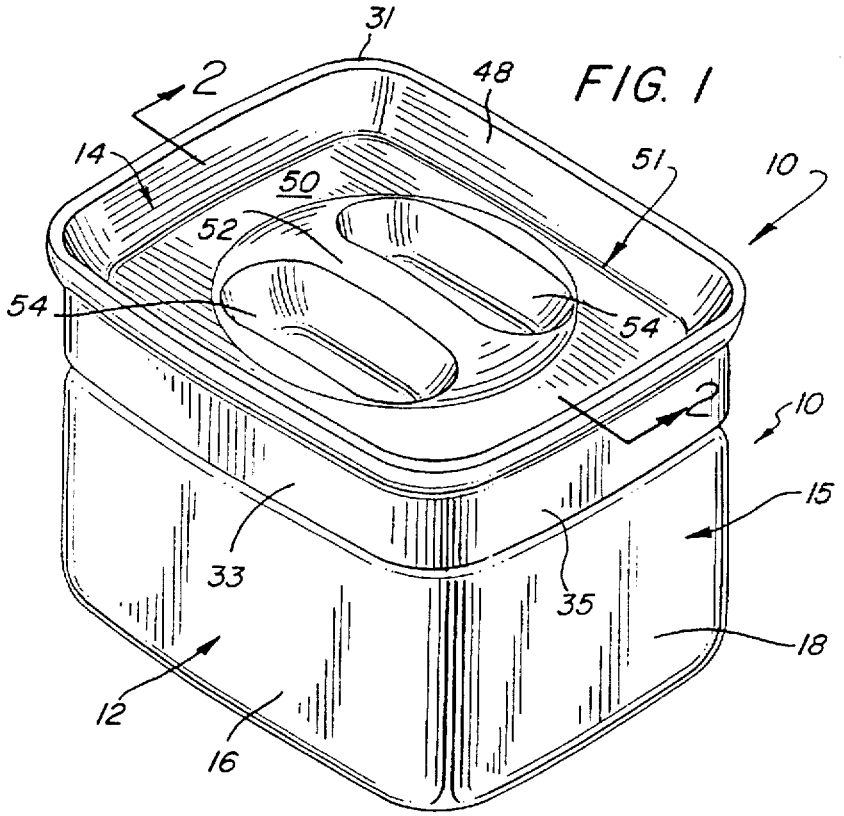
FIG. 1 is a perspective view of one embodiment of the present invention that includes a container cover and a matching container, wherein both are illustrated having matching rectangular configurations.
Figure 2:
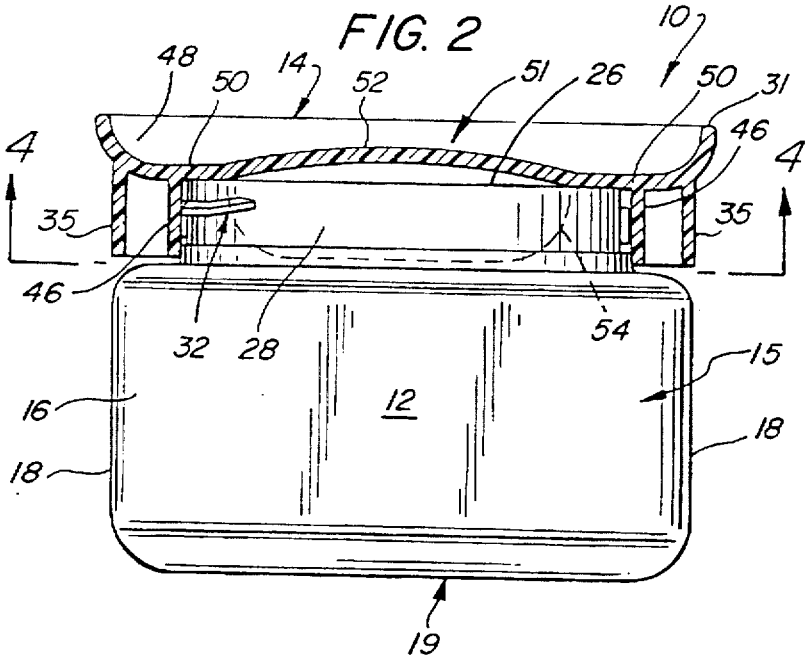
FIG. 2 is a side elevational view showing the container cover in cross-section taken substantially along line 2—2 of FIG. 1, thereby illustrating the location of the two keeper channels.

Referring to the drawing figures, there is illustrated in FIG. 1 a perspective view of a covered container, generally indicated at 10, wherein a rectangular container 12 is shown having a matching rectangular cover member 14 secured to the container 12. Container 12 comprises a wall structure or body 15 having a pair of substantially flat elongated side walls 16, end walls 18 and a bottom wall 19 which is better illustrated in FIG. 6 as being formed with a concave central portion 20, a generally annular flat portion 21 and a curved peripheral section 22 which joins the lower ends of the side and end walls. For illustrative purposes the side walls 16, end walls 18 and bottom wall 19 are integrally formed to define the interior compartment 24 in which various items can be readily stored. In the embodiment of FIGS. 1 through 6, the container is illustrated as comprising the rectangular body 15, wherein an opening 26 is defined by an annular collar 28 that protrudes upwardly from body 25 so as to further define the mouth of the container that is required to be covered a the cover member 30. See FIG. 6.

Cover member 30 is also formed with an upper peripheral edge 31 and a downwardly extending peripheral side and end walls 33 and 35, respectfully. Both the edge 31 and walls 33, 35 have a rectangular configuration to match the body of the container 12. To permit the cover member to lock onto the collar 28 and close the container while maintaining the side walls of the cover and container in alignment, there is provided a locking means, generally indicated at 32, which is integrally formed on the collar 28 of the container and a pair of cooperating keeper members 44 integrally formed on a generally circular inner cover ring 46 of the cover. See FIGS. 2–4. The locking means 32 of this embodiment includes a pair of keeper means 34 and 36. See FIGS. 4 and 5.

Figure 3:
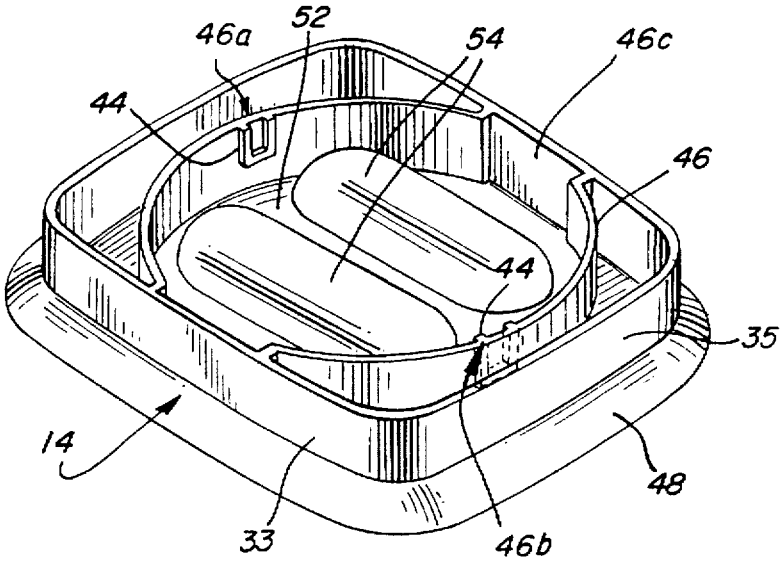
FIG. 3 is a perspective view of the container cover with the bottom side thereof in an upward exposed view, whereby the locking keeper members are shown in their respective opposite relationship to each other and their position relative to the rectangular configuration of the cover.
Figure 4:
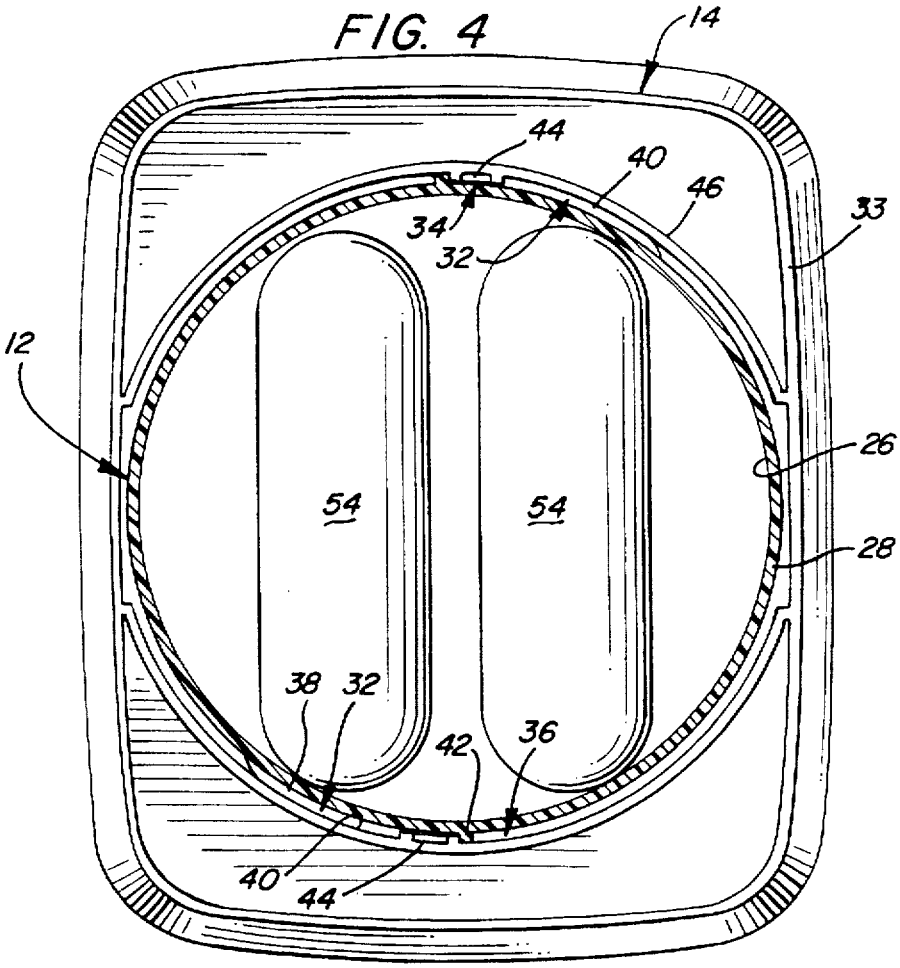
FIG. 4 is an enlarged cross-sectional view taken substantially along line 4—4 of FIG. 2, wherein the keeper members are shown in full engagement with the keeper channels, whereby the cover is locked to the collar of the container and sealed closed over the mouth of the container.
Figure 5:
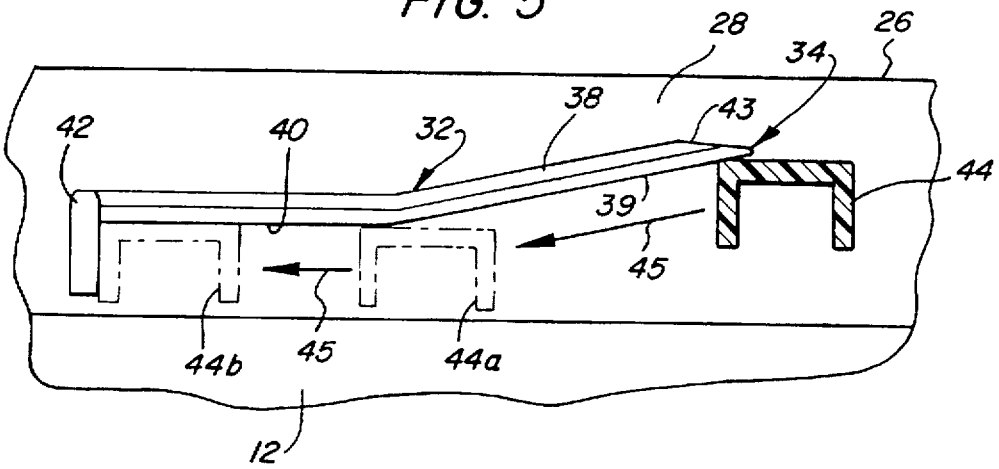
FIG. 5 is an enlarged schematic view of the path traveled by the keeper member as the cover is rotated clockwise to engage the keeper channel.

Each keeper means 34 and 36 comprises an inwardly projecting keeper rib member 38 which is formed integrally on the outer surface of the collar 28 of each container and forms a channel extending below the rib member for receiving the keeper members on the cover. As better illustrated in the schematic view of FIG. 5, keeper rib member 38 has an inclined section 39, a flat or slightly inclined section 40 and a depending stop arm 42 which is positioned to be engaged by one of the keeper members 44 as is illustrated in FIGS. 3, 4 and 5. The cover ring 46 includes generally semicircular sections **46*a* and 46*b* and a section 46*c* of each of the side walls 33 as is shown in FIG. 3. In FIG. 5, the keeper member 44 is schematically shown as being moved in a clockwise direction, as indicated by arrows 45, at first engaging the inclined section 39 of rib 38. The keeper member, depicted at positions 44*a* and 44*b*, is shown sliding under the rib 38 and along the flat or slightly inclined section 40 until fully engaged with a depending stop arm 42. In this position the side walls 33 and end walls 35 of the cover are aligned with the respective side and end walls of the container as is illustrated in FIG. 6**.

At this time the cover 14 has been fully rotated clockwise through a predetermined angle, e.g., 90°, from the entrance to the channel formed by rib 38 to the stop arm 42 at which point the cover member 14 is in a locked position and can not be removed until it is rotated in a counterclockwise direction.

Figure 6:
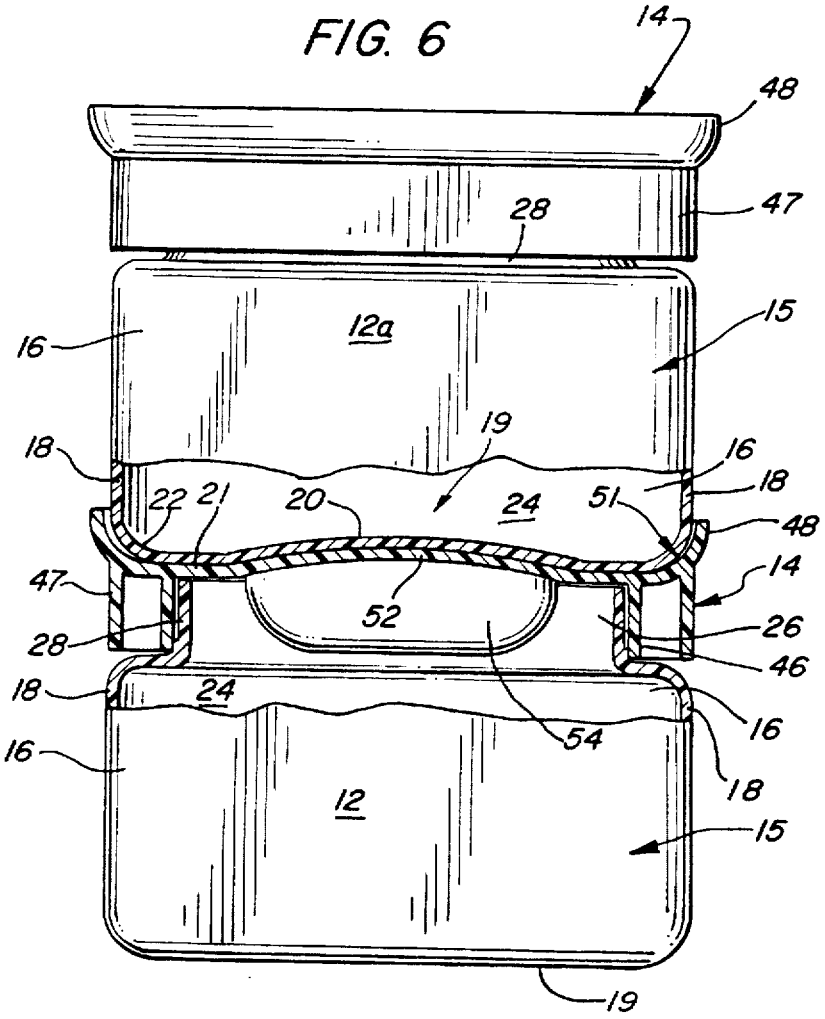
FIG. 6 is a side elevational view of two containers one mounted over and on a second container wherein the top container is received and supported within the lower positioned cover.

The annular downwardly depending peripheral walls 33, 35 of the cover member 14 define a skirt generally indicated at 47 in FIG. 6 for covering the neck of the container and providing a continuation of the side and end walls thereof. A shallow curved flange 48 (FIG. 1), which matches the curved end section 22 of the container bottom, is integrally formed with the skirt and extends upwardly from a generally annular flat portion 50 of the top wall of the cover. The annular flat portion 50 matches the flat portion 21 of the container bottom. The top wall of the cover member further defines a convex central portion 52 which matches the concave central portion 20 of the container bottom. A pair of finger recesses 54 are formed in the convex portion 52 whereby the cover 14 can be conveniently rotated and removed from the container by a user. The top wall (portions 50 and 52) and the curved flange 48 define a receptacle 51 for receiving the bottom of a matching container.

Figure 7:
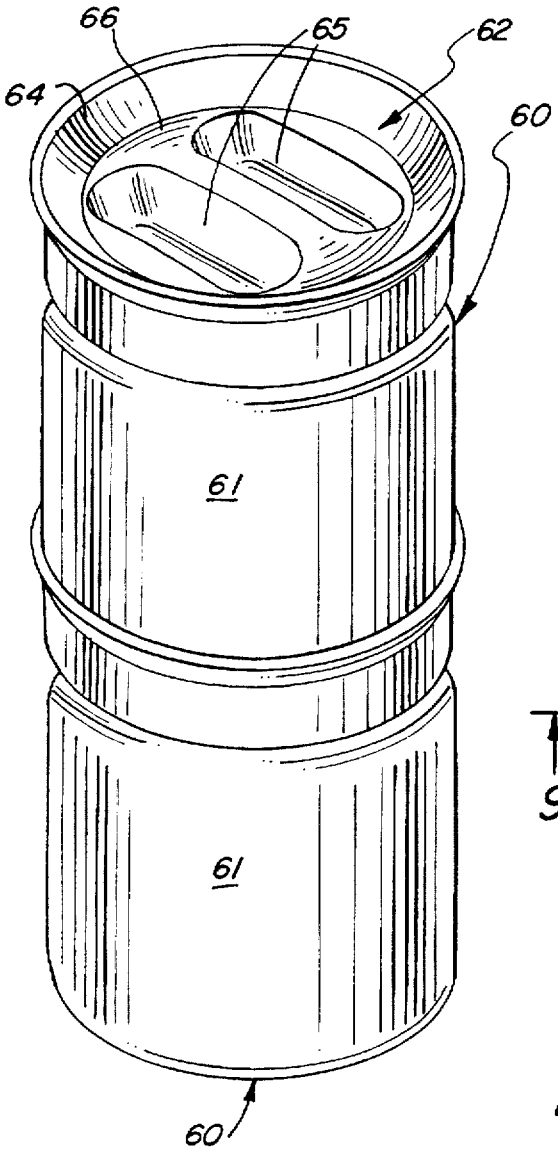
FIG. 7 is a perspective view of a pair of stacked cylindrical containers having round cylindrical configurations matching that of the container.
Figure 8:
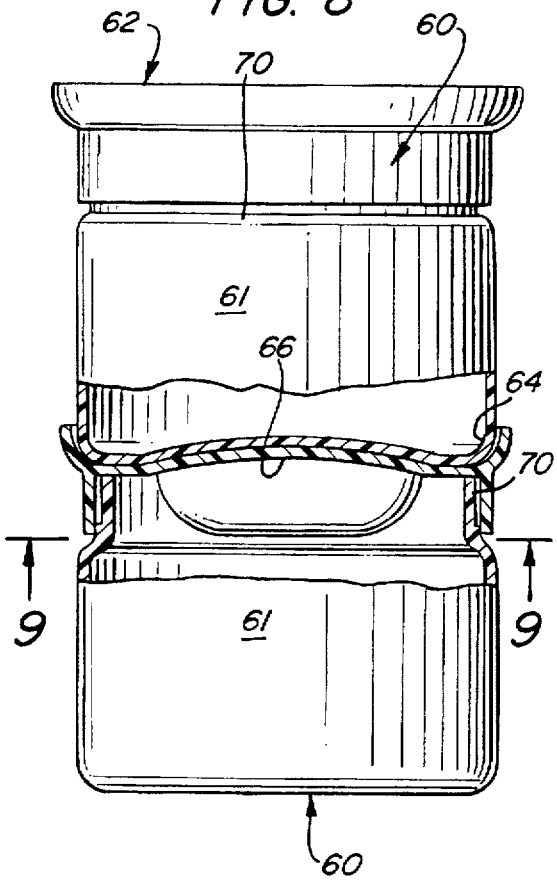
FIG. 8 is a side-elevational view to FIG. 7 with the central portion thereof broken away to illustrate the two containers in a stacked relationship to each other.
Figure 9:
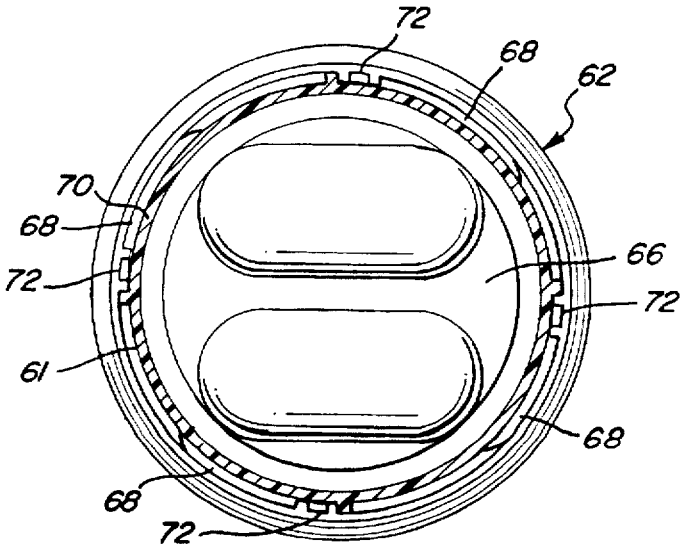
FIG. 9 is a cross-sectional view taken substantially along line 9—9 showing the alternative method of securing the a round cover member to a round container.

Referring now to the alternative embodiment which is illustrated in FIGS. 7 through 9, there is shown a pair of the identical circular or cylindrical stacked body members 61 and circular cover members 62. Cover 62 is similar to that described above having a receptacle or recess 64 defined in the top wall 66 thereof, which also includes a pair of finger recesses 65 for rotating the cover member. The receptacle 64 is adapted to receive the superposed container therein, as illustrated in FIG. 8.

FIG. 9 is a cross-sectional view taken along line 9—9, whereby the arrangement shows at least four equally spaced-apart keeper channels 68 about the annular collar 70 of the container. Since the cylindrical configuration of the containers 60 and matching cover members 62 are identical, the cover member can be attached and rotated about the annular collar without the restriction that prevails when the container and cover are both rectangular. Accordingly, for each keeper channel 68 the same number of keeper members 72 is required.

The containers are preferably molded of a clear plastic, e.g., TPE and the cover members are made of polypropylene.

The foregoing should only be considered as illustrative of the principles of the invention. Further, since numerous modifications and changes may readily occur to those skilled in the art, it is not desired to limit the invention to the exact construction and operation as shown and described, and accordingly, all suitable modifications and equivalents may be resorted to, falling within the scope of the claimed invention.

What is claimed is:

1. In combination, a cover member arranged to be secured over the open mouth of a container, wherein the combination comprises:

a container having a body member in which is formed an annular collar that defines the open mouth of the container;

a cover member having a configuration corresponding to the configuration of said container and formed having an inner annular cover ring;

a plurality of keeper means integrally formed in said collar of said container and interposed between said collar and said inner annular cover ring;

a plurality of keeper members integrally formed on said inner annular cover ring and positioned to be lockingly received in respective keeper means; and wherein said cover member is formed having a receptacle arranged to receive the lower portion of said container for stacking thereon.

2. The combination as recited in claim 1, wherein at least two of said keeper means are formed on said collar and wherein said at least two keeper members are positioned to engage respective keeper means when said cover member is rotated through a predetermined angle at least 90° in a clockwise direction.

3. The combination of claim 2 wherein the predetermined angle is about 90°.

4. The combination as recited in claim 2, wherein each of said keeper means comprises a keeper channel formed to receive said keeper member therein.

5. The combination as recited in claim 4, wherein each of said keeper channels is formed with an elongated rib member having a depending stop member so as to be engaged with said keeper member, thereby limiting the rotational movement of said cover member, whereby said cover member is fully engaged in a locked position within said keeper channel.

6. The combination as recited in claim 5, wherein said container is formed having a rectangular configuration and said cover member is formed having a matching rectangular configuration.

7. The combination as recited in claim 6, wherein said rectangular container comprises:

a pair of oppositely disposed elongated side walls, oppositely disposed end walls, and a bottom wall, all of which are integrally formed to define an interior compartment in said body member, and wherein said collar at the top of said compartment defines said opening therein; and wherein one of said keeper channels is positioned above and adjacent one of said end walls, and the other said keeper channel is mounted above and adjacent said oppositely disposed end wall.

8. The combination as recited in claim 7, wherein the rectangular cover member comprises:

a top wall with an upwardly extending curved peripheral flange, the top wall and flange being configured to receive the bottom of the container; and a peripheral downwardly depending skirt integral with said top wall and integrally formed with said inner annular cover ring and wherein said keeper members are oppositely positioned from each other and arranged to slidably engage said respective keeper channels as said cover member is rotated with respect to said keeper channels.

9. The combination as recited in claim 7, wherein said top wall of said rectangular cover member is formed having a concave-convex central portion in which is formed a pair of finger recesses, whereby said cover member is removably rotated.

10. The combination as recited in claim 1, wherein at least four of said keeper means are formed on said collar and wherein at least four of said keeper members are positioned to engage said respective keeper means when said cover member is rotated at least 90°, in a clockwise direction.

11. The combination as recited in claim 9, wherein each of said keeper means comprises a keeper channel formed to receive said keeper member therein.

12. The combination as recited in claim 10, wherein each of said keeper channels is formed with an elongated rib member having a depending stop member so as to be engaged with said keeper member, thereby limiting the rotational movement of said cover member, whereby said cover member is fully engaged in a locked position within said keeper channel.

13. The combination as recited in claim 5, wherein each of said containers and said cover member are formed having a corresponding cylindrical configuration.

14. The combination as recited in claim 5 wherein said container is formed having a circular configuration and said cover member is formed having a matching circular configuration.

15. The combination as recited in claim 14 wherein said circular container comprises:

a cylindrical upstanding wall and a bottom wall, all of which are integrally formed to defense an interior compartment in said body member, and wherein said collar at the top of said compartment defines said opening therein; and wherein said keeper channels are spaced about the circumference of the annular collar.

16. The combination as recited in claim 15 wherein the rectangular cover member comprises:

a top wall with an upwardly extending curved peripheral flange, the top wall and flange being configured to receive the bottom of the container; and a peripheral downwardly depending skirt integral with said top wall and integrally formed with said inner annular cover ring and wherein said keeper members are oppositely positioned from each other and arranged to slidably engage said respective keeper channels as said cover member is rotated with respect to said keeper channels.

17. The combination as recited in claim 16, wherein said top wall of said rectangular cover member is formed having a concave-convex central portion in which is formed a pair of finger recesses, whereby said cover member is removably rotated.

18. The combination of an open mouth container and a cooperating cover member comprising:

a container having a plurality of substantially straight upright walls, a closed bottom and an annular collar that defines the open mouth of the container;

a removable cover member having a peripheral edge with a configuration matching the configuration of the upright walls of the container and formed having an inner generally annular cover ring which is arranged to rotate around the annular collar, the cover ring and annular collar having adjacent facing surfaces when the cover member is positioned over the collar;

at least two spaced elongated channels formed in one of the facing surfaces;

at least two radially outwardly projecting keeper members formed in the other facing surface, each of the channels having an entrance end for receiving the respective keeper member and a terminal end for engaging the respective keeper member to stop further rotation of the cover member when the peripheral edge of the cover member is aligned with the walls of the container.

19. The combination as recited in claim 18 wherein the channels are formed on the annular collar of the container and the keeper members are formed on the cover ring.

20. The combination of claim 19 wherein the cover member includes a skirt depending downwardly from the peripheral edge, the skirt having a configuration which matches the configuration of the upright walls of the container.

21. The combination of claim 20 wherein the container walls and the peripheral edge of the cover member have a rectangular configuration.

22. A stackable container and cover member comprising:

a container having a bottom, side walls, a bottom and an annular collar that defines the mouth of the container, the bottom having a concave central section, a flat generally annular section surrounding the central section and a peripheral curved section joining the flat section to the side walls;

a cover member having an upper wall with a configuration corresponding to the bottom of the container to permit a container to be stacked thereon and formed with an inner annular cover ring, the cover ring having an inner surface adapted to extend over the container collar;

at least one channel formed in the inner surface of the collar; and at least one projecting stub carried on the inner surface of the cover ring, the projection being arranged to seat the channel upon rotation of the cover member relative to the container to releasably lock the cover member over the mouth of the container.

* * * * *